US005362269A

United States Patent [19]

Leach

[11] Patent Number: 5,362,269

[45] Date of Patent: Nov. 8, 1994

[54] PERSONAL WATER VEHICLE

[76] Inventor: Peter M. Leach, 2705 S. Center St., Santa Ana, Calif. 92704

[21] Appl. No.: 968,509

[22] Filed: Oct. 29, 1992

[51] Int. Cl.[5] ..... B63H 25/00

[52] U.S. Cl. ..... 441/65; 114/144 R; 440/40; 440/87

[58] Field of Search ..... 440/38, 39, 40, 41, 440/42, 43, 87, 68, 69, 70, 49; 441/65, 74, 79; 74/480 B; 114/270, 144 R

[56] References Cited

U.S. PATENT DOCUMENTS

| | | | |
|---|---|---|---|
| 3,270,707 | 9/1966 | Rozanski | 440/87 |
| 3,324,822 | 6/1967 | Carter | 440/38 |
| 3,339,514 | 9/1967 | Skuce, II | 440/49 |
| 4,020,782 | 5/1977 | Gleason | 114/220 |
| 4,437,841 | 3/1984 | Tallman | 440/38 |
| 4,813,898 | 3/1989 | Nakase et al. | 440/38 |
| 4,840,592 | 6/1989 | Anderson | 441/65 |
| 4,857,025 | 8/1989 | Brown et al. | 441/65 |
| 4,886,476 | 12/1989 | Brocone et al. | 441/65 |
| 4,962,717 | 10/1990 | Tsumiyama | 440/87 |
| 5,199,913 | 4/1993 | Toyohara et al. | 440/38 |
| 5,203,728 | 4/1993 | Kobayashi | 440/38 |
| 5,209,683 | 5/1993 | Imaeda et al. | 440/38 |

*Primary Examiner*—Stephen P. Avila

*Attorney, Agent, or Firm*—Chris Papageorge

[57] ABSTRACT

A jet motor powered water vehicle is disclosed which is designed for single person use. The jet powered boat includes a deck having a flat surface portion enabling a person to lie prone thereon while manually controlling the motor and steering the boat by utilizing of a joystick mounted on the deck. The hull of the boat has a generally wide and shallow V-shaped configuration at a bore, lower portion thereof. The hull also has a flat bottom surface at mid and aft lower portions thereof which blend with the V-shape. The hull also includes a rear portion which is curved and upwardly slanted at a lower portion thereof. The boat also includes a transom which is generally rounded for improved aquadynamics, and a shroud generally enclosing the nozzle for the motor impeller is contoured and shaped to generally conform to the V-point of the hull in order to enhance aquadynamics of the hull. The shroud is provided with a water inlet hole for the motor impeller but is otherwise generally closed to prevent water flow through the shroud and water turbulence adjacent the nozzle which would otherwise tend to impede free movement of the nozzle within the shroud. A pair of gunnels mounted on the deck provide lateral support to the user as well as fuel system ventilation and an easily accessible fuel filler.

23 Claims, 7 Drawing Sheets

PERSONAL WATER VEHICLE

BACKGROUND OF THE INVENTION

The present invention relates generally to motorized water vehicles and, more particularly, to jet-powered sport boats designed for use by a single person.

Beginning with the advent of the jet ski water vehicle, single person water vehicles have become increasingly popular over the years due in part to their ability to impart a feeling of speed and freedom to the user thereof. In their ongoing quest for new thrills, users of aquatic sports vehicles have looked to diverse aquatic craft including the jet-powered water ski boat. A primary reason for the wide spread appeal of the jet ski boat is that its small size and personal control thereof enables the user to feel more integrated with the boat as if it is an appendage of the user. The wide spread appeal of the jet ski boat is also due in part to its maneuverability and its ability to impart a sensation of high speed to the user. In this type of boat, the user stands generally upright on a relatively small generally planar hull while the craft generally skims on the surface of the water like an ordinary water ski. While such a water ski type of craft is very enjoyable to the user, it has an important drawback due to its hull shape and its positioning of the user in an upright stance thereon which raises the center of gravity of the craft. Essentially, this drawback is that its relatively high center of gravity and its generally planar bottom surface make the craft susceptible to capsizing during very quick or sharp turning maneuvers. In addition, since the user is standing generally upright thereon, the user is not securely positioned on the boat. The user is able to brace him:self or herself only by firmly gripping the handlebars. Consequently, the user may be susceptible to falling off the craft if the user inadvertently loosens his or her grip on the handlebars.

Recognizing that a boat in which a user may simply lie prone thereon would be providing an enhanced sensation of speed to the user as well as providing a generally lower center of gravity for enhanced maneuverability, some prior art craft have been designed which specifically allow the user to lie prone on a deck surface thereof. An example of such a prior art craft is disclosed in U.S. Pat. No. 3,270,707 to Rozanski. The Rozanski craft also includes sidewalls located on the deck to provide lateral support to the user's torso as well as to support the user's forearm. However, a primary disadvantage of the Rozanski device is that it requires the user to steer the craft by means of leg movements against flaps located on rear underside portions of the craft. Another disadvantage of the Rozanski device is that it is propelled by a simple propeller located underneath the craft and is therefore not entirely safe to the user or to other person's who may be proximal thereto. This is because the propeller produces an underwater vacuum and the relative proximity of the propeller to the user may result in the vacuum drawing the user's limbs into the propeller causing injury thereto.

Other prior art aquatic crafts have incorporated various types of manual control systems for a one-person craft. An example of such a prior art device is disclosed in U.S. Pat. No. 3,339,514 to Skuce II. The Skuce device is essentially a hydrofoil boat having a hull with varying draft in order to provide improved speed. The Skuce craft also incorporates a joystick-type of manual control attached to the rudder in order to steer the craft.

However, since the Skuce craft requires a user to be in a seated position while using the craft, the Skuce craft's center of gravity is therefore relatively high and its maneuverability is thereby compromised.

Other prior art aquatic craft allow conversion from a unmotorized craft to a motorized craft. An example of such a prior art aquatic craft is disclosed in U.S. Pat. No. 4,020,782 to Gleason. The Gleason craft is essentially a surf board which is capable of being used in both a powered and unpowered state. The underside of the hull of the Gleason craft is generally planar with a portion which deepens from the fore and art surface portions into a point at the medial portion thereof . The Gleason craft also includes a set of handlebar. The Gleason craft positions the user in a prone position thereby lowering the center of gravity of the craft and therefore its resistance to capsizing. However, due to its hull bottom surface shape the Gleason craft is adapted for generally skimming on the surface of the water and is therefore not very maneuverable nor easily steerable.

What is needed is a single person boat provided with a jet motor for safety and speed . In addition, such a single person boat is also needed which is capable of providing a relatively high degree of safety to the user in the event of use in rough waters. As single person boat is also needed which has a relatively high degree to maneuverability and stability.

SUMMARY OF THE INVENTION

It is a principal object of the present invention to provide a powered boat for single person use thereof.

It is also an object of the present invention to provide a powered boat allowing a person to lie prone thereon while using the boat.

It is also an object of the present invention to provide a powered boat having a relatively high degree of safety for the user and others proximal thereto.

It is also an object of the present invention to provide a powered boat providing a relatively high degree of maneuverability thereto.

It is also an object of the present invention to provide a powered boat capable of a relatively high degree of speed.

It is also an object of the present invention to provide a powered boat which allows the user to steer the boat by means of a handle.

It is also an object of the present invention to provide a powered boat in which the boat motor may be operated by means of a single manual control.

It is also an object .of the present invention to provide a powered boat which may be operated and steered by means of a joystick.

It is also an object of the present invention to provide a powered boat for single person use which has a relatively high degree of stability during operation thereof.

It is also another object of the present invention to provide a boat for single person use which is powered by a jet motor.

Essentially, the boat of the present invention is specifically designed to enable a single person to lie prone thereon while operating the boat. This generally lowers the center of gravity of the boat for improved maneuverability and stability and also generally prevents injury to a user by making it less likely the user will fall off the boat during operation thereof. The unique hull of the present invention has a pointed portion which extends generally from the fore portion of the hull underside and gradually deepens too the medial portion of the underside. The medial and rear portions of the hull underside is generally flat and the flat portion generally blends into the pointed portion at the front of the medial underside portion. The pointed (V-shaped) portion in combination with the flat portion provides the boat with enhanced stability (particularly during maneuvering) and high speed capability. The hull underside also includes pointed projections at lateral portions thereof for improving the lateral stability of the craft. An upwardly slanted rear portion of the hull underside is provided to generally enhance the aquadynamics of the craft and thereby increase its speed. The aquadynamics of the craft is also further enhanced by rounding the lateral edges of the transom of the hull.

The boat's deck has a generally flat portion surface in order to enable a user to lie prone thereon with the user's lower legs positioned so that they extend from the rear of the craft. The deck is also provided with gunnels positioned laterally of the user's torso in order to provide a degree of lateral support to the user. A forearm support and a hand grip are also provided. The forearm support is positioned on the deck in front of the user's head and the hand grip comprises a rail positioned between and attached to one of the gunnels and the forearm support. Due to the prone position of the user on the craft and the hand grip and other supports provided, the user is less likely to fall or slip off the craft than with other prior art craft in which the user is sitting or standing thereon.

The boat of the present invention is provided with a control in the form of a joystick mounted on the deck. The joystick is provided with throttle and on/off controls for the motor and also controls rotational movement of the nozzle for steering the craft. Since these controls are provided on a single stick, the user need only grip that single control for complete operation of the vehicle and can put his other hand on the grab rail to stabilize himself and retain himself in the desired position on the deck during maneuvering of the craft.

The joystick control is preferably hingedly mounted on the deck enabling the joystick to generally safely fold forward in the event that rough waters, quick deceleration or other circumstances forcibly move the user forward on the deck up against the joystick. The folding forward feature thus prevents injury to the user under such circumstances.

The boat of the present invention is powered by a jet motor and an impeller which are mounted in a cavity of the hull. A nozzle generally encloses the impeller at its lateral and lower portions. Use of an impeller structure rather than a propeller structure provides an added degree of safety to the craft because it is less likely that the impeller would cause damage to persons or marine life. In contrast to a typical propeller, an impeller is generally enclosed and is therefore less likely to draw something into its blades. The nozzle is generally enclosed by a shroud which is shaped and dimensioned so that it generally blends into the flat underside hull portion which blends into the pointed V-shaped portion of the underside of the hull in order to generally extend the desired underside hull configuration to the rear of the boat. The shroud is also provided with an inlet hole and an outlet hole allowing water drawn into the impeller chamber to be set into motion and expelled through the nozzle for propulsion of the craft. The shroud is spaced a desired distance from the nozzle order to allow free movement to the nozzle for steering the craft and the shroud is generally closed (except for the nozzle inlet and outlet) in order to generally prevent water turbulence in the area between the nozzle and the shroud. Minimizing water turbulence in the area surrounding the nozzle minimizes the water turbulence forces on the nozzle thereby permitting freer movement of the nozzle within the shroud, The freer movement of the nozzle within the shroud provides a better steering feel to the controls enabling improved steering of the craft and generally enhancing the capabilities of the craft.

DETAILED DESCRIPTION OF THE PREFERRED EMBODIMENT

Figure 1:
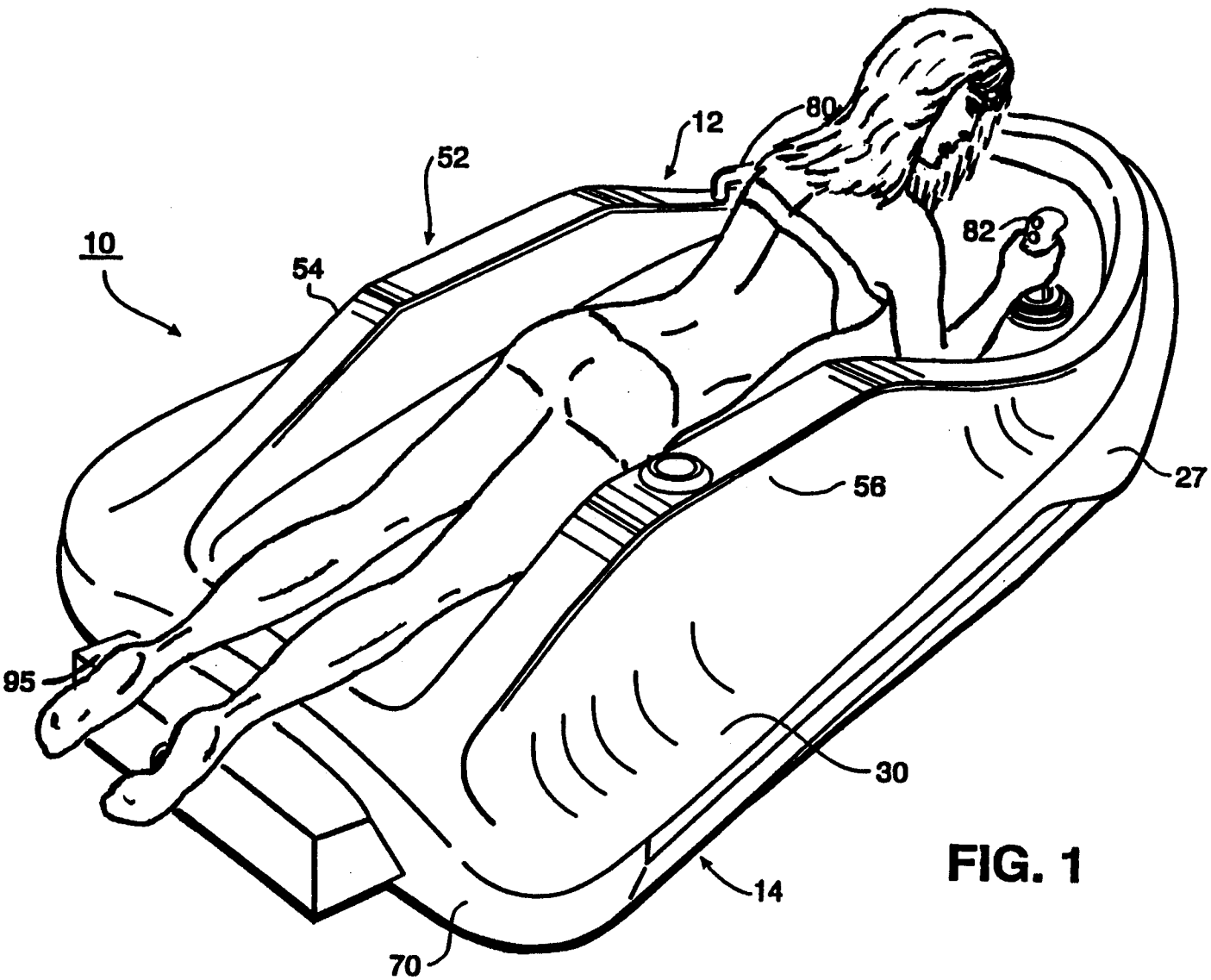
FIG. 1 is a perspective view of the boat of the present invention showing a user lying in a prone position thereon.
Figure 2:
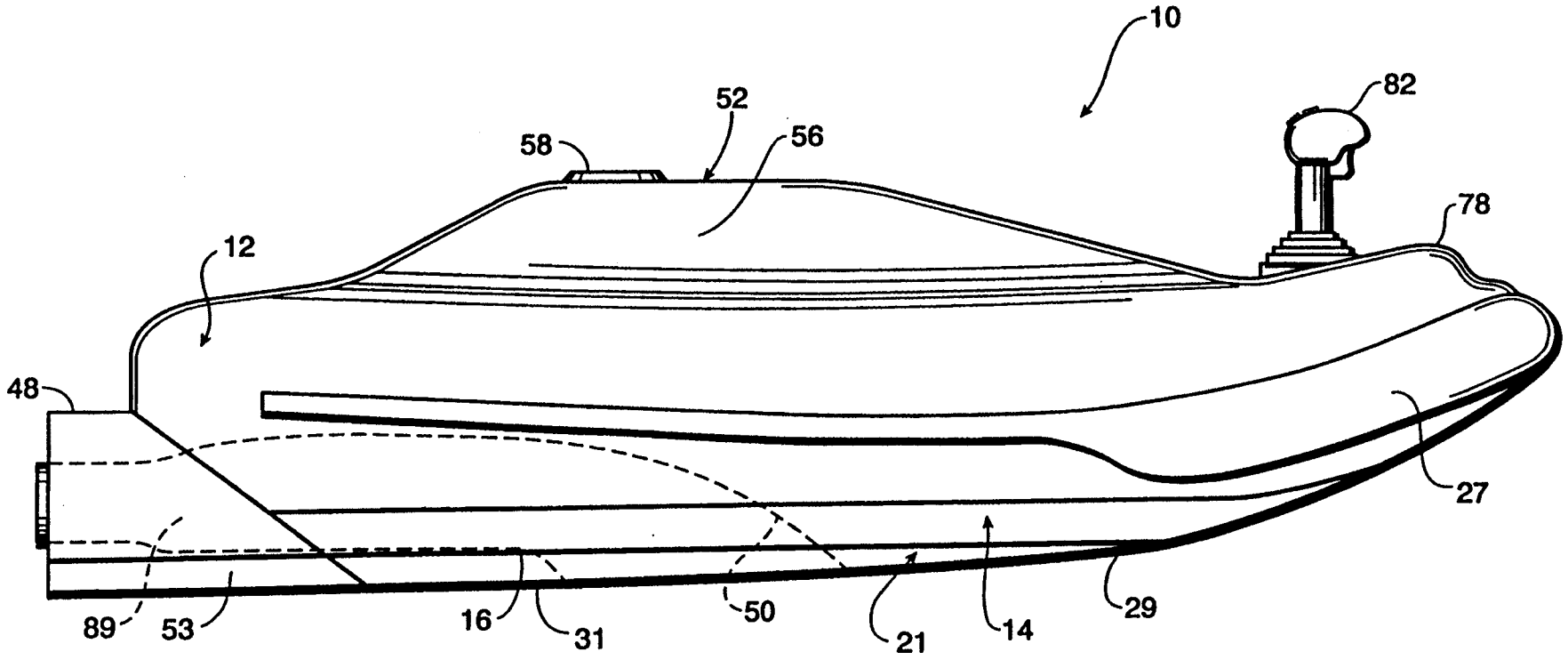
FIG. 2 is an isometric side view of the boat of the present invention showing the general shape of the hull.
Figure 4A:
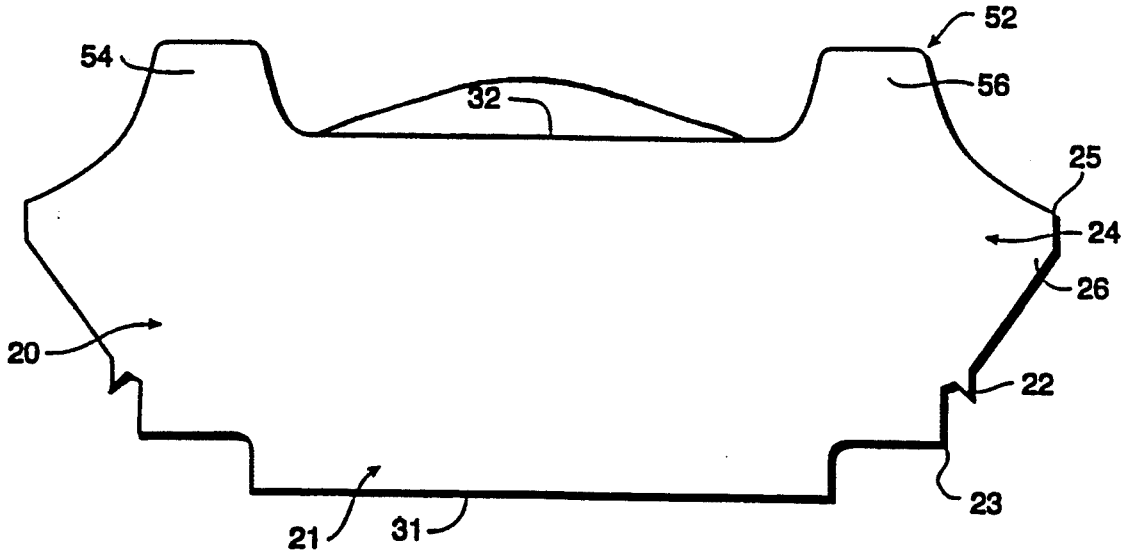
FIG. 4A is a cross-sectional view of the boat of the present invention taken along lines 4A—4A of FIG. 3 showing the gunnel height and illustrating the flat underside hull shape.
Figure 4B:
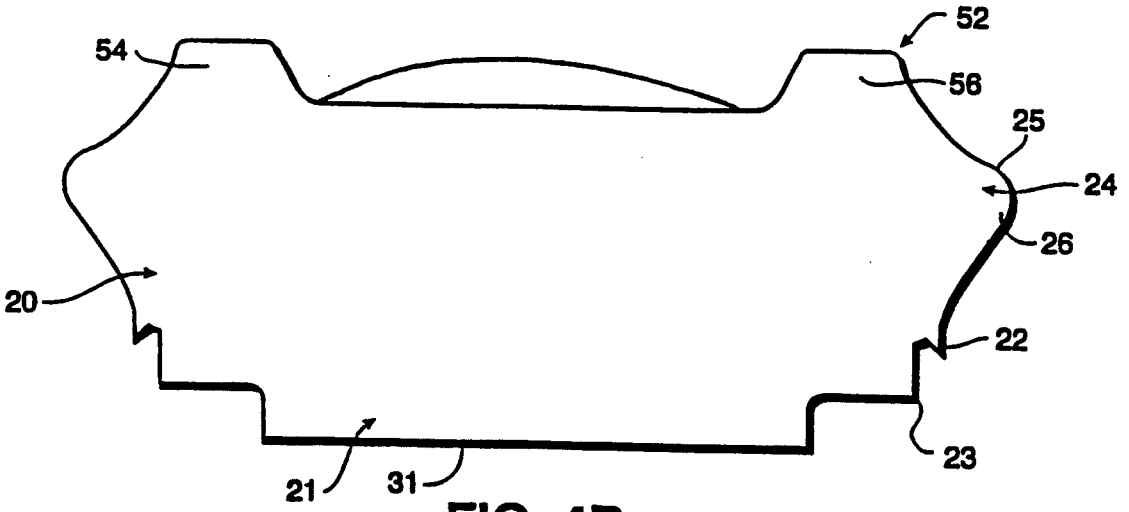
FIG. 4B is a cross-sectional view of the boat of the present invention taken along lines 4B—4B of FIG. 3 showing the gunnel height and illustrating the flat underside hull shape.
Figure 4C:
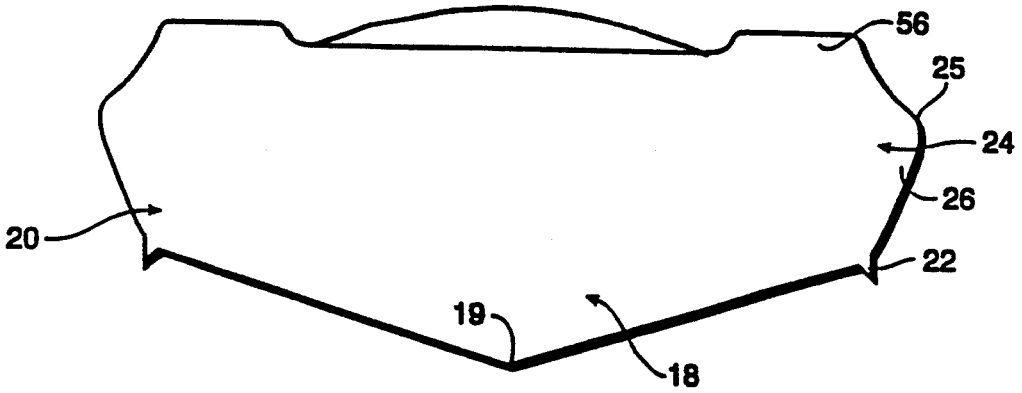
FIG. 4C is a cross-sectional view of the boat of the present invention taken along lines 4C—4C of FIG. 3 illustrating the pointed underside hull shape.
Figure 5:
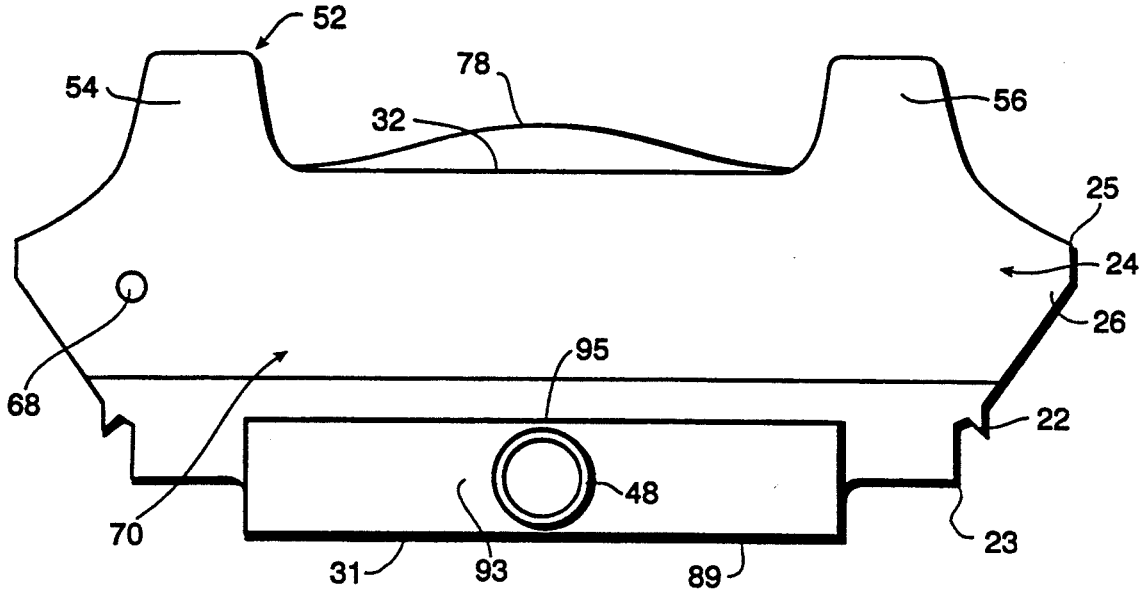
FIG. 5 is an isometric rear view of the boat of the present invention showing the shape of the transom and hull.

Referring now to the drawings, the powered boat of the present invention is generally designated by the numeral 10. Boat 10 preferably includes a hull 12 having a lower hull portion 14 with a lower surface 16 thereof. The lower hull portion 14 preferably has a generally V-shaped fore portion 18 having a longitudinal point 19 at preferably a longitudinally medial location thereof. Thus, the fore (or front) lower portion 18 of hull 12 has a pointed portion 19 which is approximately or generally deepest at the medial location and the lower hull portion 14 extends laterally therefrom generally upwardly to approximately lateral portions 20 thereof. The lower surface 16 also has a generally flat mid and aft bottom portion 21, as shown in FIG. 2. The flat bottom portion 21 has a generally flat surface 31 extending longitudinally from a transition point (or portion) 29 at the forward mid portion of the lower hull portion 14 to the rear portion 70. The flat bottom surface 31 also extends laterally across the bottom portion 21 to terminate in pointed chines. 23 at lateral ends thereof, as shown in FIGS. 4A and 4B. The point 19 of V-shaped portion 18 also extends longitudinally forwardly and upwardly from the transition point (or portion) 29. The point 19 of V-shaped portion 18 generally blends with the flat surface 31 of flat bottom portion 21. The V-shaped portion 18 is relatively wide and shallow in comparison to the overall structure of the boat 10. The pointed portion 19 is approximately 4 inches below the transom 24. The V-shaped portion 19 is approximately 28 inches wide . The transom 24 preferably has protuberances or extended portions 26 which are preferably approximately 8 inches in vertical height, tapering out to approximately 2-½ inches in vertical height. The general shape of the hull 12 is such that the transom 24 extends laterally outward to a greater degree at the aft of the hull 12 than at the fore of the hull 12, as shown in FIGS. 4A, 4B and 5. This allows the boat 10 to more easily maintain straight line movement through the water, in addition, the transom 24 has edge portions 25 which are generally rounded in order to improve the aquadynamics characteristics of the boat 10. A rub rail or bumper 27 is also mounted around the front and lateral portions of the hull.

A deck 28 is preferably mounted on the top portion 30 of the hull 12. The deck 28 preferably has a generally flat surface portion 32 thereof which allows and is preferably dimensioned to accommodate a single person lying prone thereon while operating the boat 10. The deck 28 preferably at the flat portion 32 is provided preferably with a hatch 34 providing access to a cavity 36 in the hull 12. A motor 38 is preferably mounted in the cavity 36. The motor 38 is preferably a jet motor utilizing gasoline fuel although other suitable types of motors may also be utilized, if desired. Motor 38 is preferably operatively connected to an impeller 40 via impeller shaft or drive shaft 42. The impeller 40 is preferably mounted in an open area or chamber 44, generally defined by a tube 46 which generally encloses the impeller 40 and which terminates at a nozzle 48. The tube 46 preferably has an aperture for receiving the impeller shaft 42 and an inlet portion 50 for allowing water to enter the chamber 44 so that the impeller 42 can expell the water out of the chamber 44 and through the nozzle 48 thereby propelling the boat 10. The tube 46 is preferably mounted in the cavity 36 with the nozzle 48 preferably mounted on the lower hull portion 14 and positioned approximately rearward of the impeller 40. The nozzle 48 generally extends from the rear portion 70 of the hull 12. The nozzle 48 is preferably rotatably attached to the tube 46 and preferably horizontally rotatable thereby controlling the direction in which the water is expelled from the nozzle 48. Thus, operation of the nozzle 48 enables the boat 10 to be steered.

Figure 3:
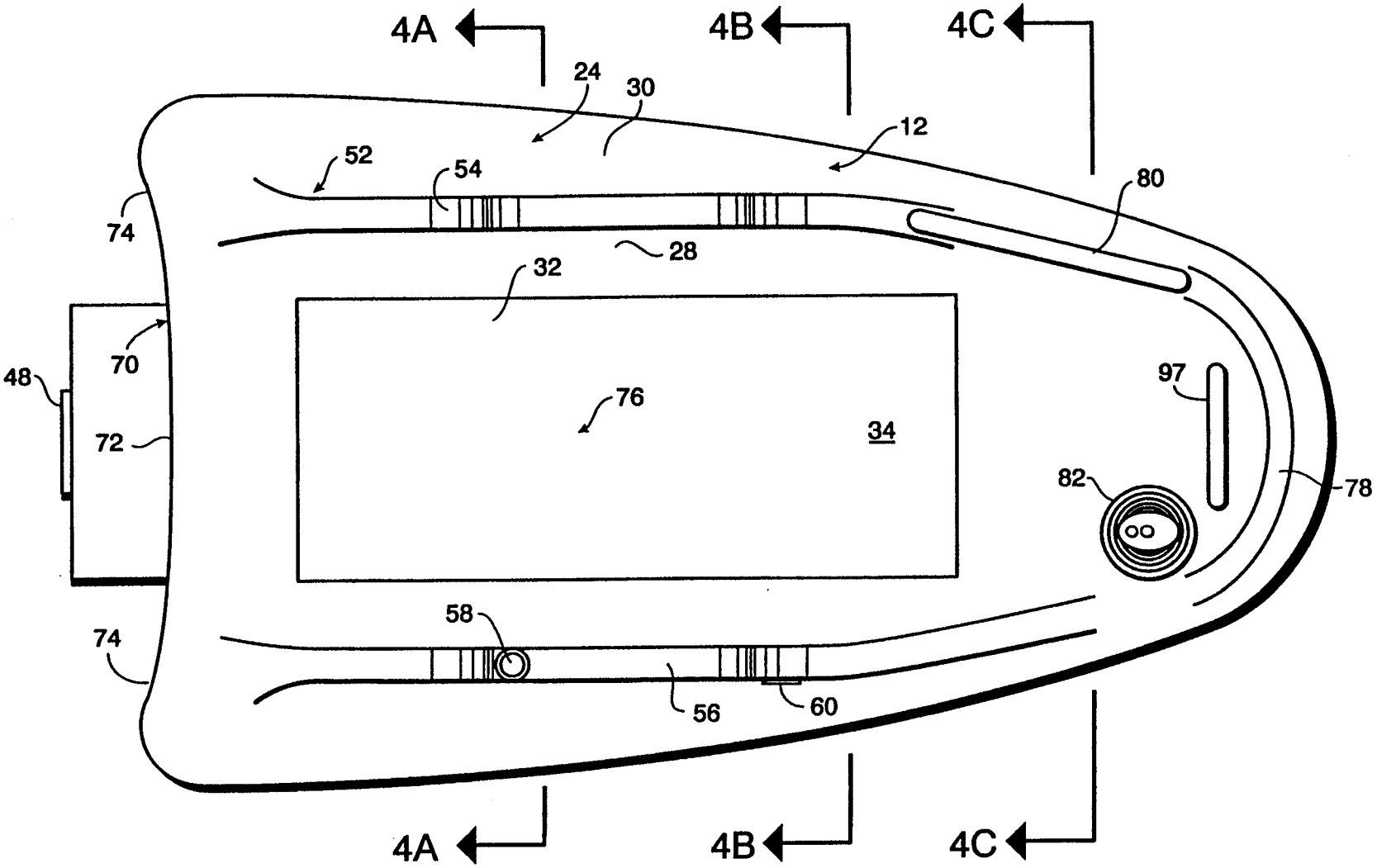
FIG. 3 is an isometric top view of the boat of the present invention showing the general shape of the hull.

The motor 38 is preferably in a laterally tilted position in order to provide better balance to the boat 10. In addition, this tilted positioning of the motor 38 also enables the hull 12 of the boat 10 to be lower in vertical cross-section resulting in a lower center of gravity providing improved stability and maneuverability. The deck 28 is preferably provided with a gunnel 52. The gunnel 52 preferably includes a left gunnel structure 54 and a right gunnel structure 56. Gunnel structures 54 and 56 are preferably positioned laterally of the flat portion 32 in order to provide lateral support to the user when lying prone on the flat portion 32 and also to generally retain the user on the flat portion 32 during maneuvering of the boat 10. Gunnel structures 54 and 56 are preferably approximately 4-⅛ inches in height at the rear or aft portion 70 and tapering down to approximately 4 inches at the fore portion 71. Gunnel 52 preferably also has a fuel vent 58 mounted on preferably a rear portion of the right gunnel structure 56. In addition to the fuel vent 58, the gunnel 52 preferably also includes a fuel filler structure 60 mounted on preferably a medial portion of the right gunnel structure 56. Fuel vent 58 and fuel filler 60 are preferably connected to fuel tanks 62 preferably by means of hoses 64. The exhaust pipe 66 of motor 38 preferably terminates at an exhaust outlet 68 located preferably at the rear or aft portion 70 of hull 12. The aft portion 70 is preferably laterally curved so that a medial portion 72 thereof is more proximal a central portion 76 of hull 12 than lateral portions 74 of the aft portion 70, as shown in FIG. 3. This rearwardly and laterally curved aft portion 70 provides improved aquadynamics to the hull 12 thereby improving its speed capability.

Deck 12 is preferably also provided with a forearm rest 78. Utilization of forearm rest 18 helps prevent undesired forward movement of the user during operation of the craft 10. In addition, the deck 28 is preferably also provided with a gripping rail 80 which is connected at ends thereof to preferably left gunnel portion 54 and to forearm rest 78. Hand grip rail 80 preferably allows the user to be relatively securely positioned on the flat portion 32 in his or her desired position and also allows the user to manually stabilize himself or herself during craft maneuvers or quick acceleration and deceleration. Thus, forearm rest 78 in conjunction with grip rail 80 allow the user to be in a more stable and secure position on the boat 10 and therefore more safely positioned on the boat 10 during use thereof.

Figure 8:
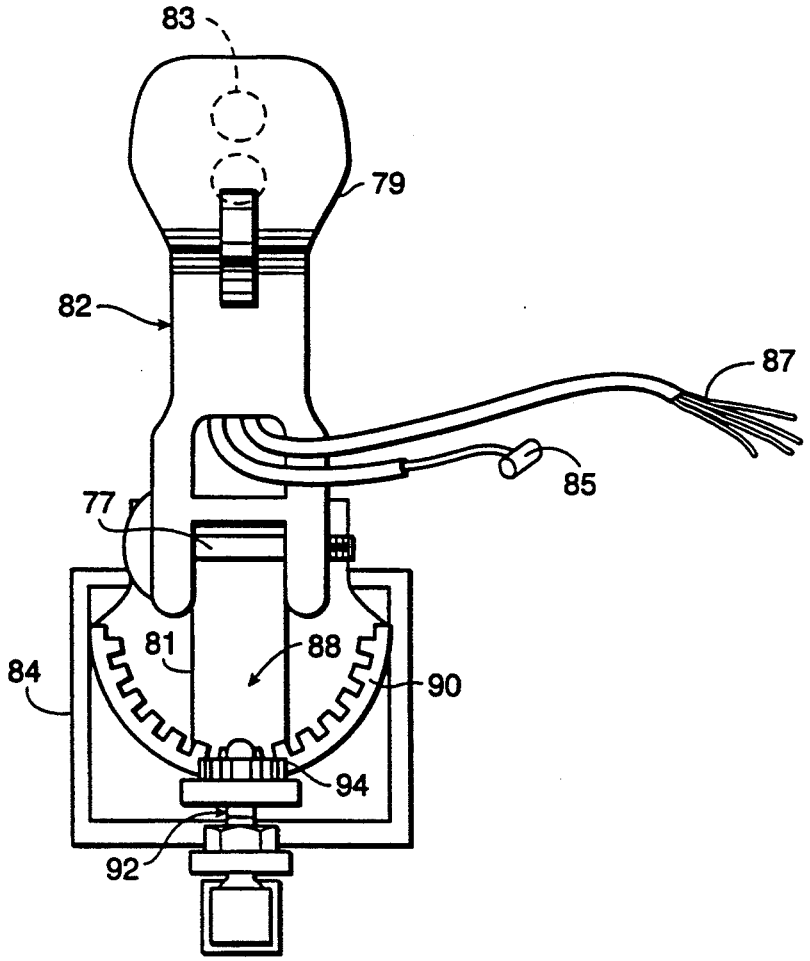
FIG. 8 is an isometric rear view of the control stick and rack and pinion structure to the boat of the present invention.
Figure 6:
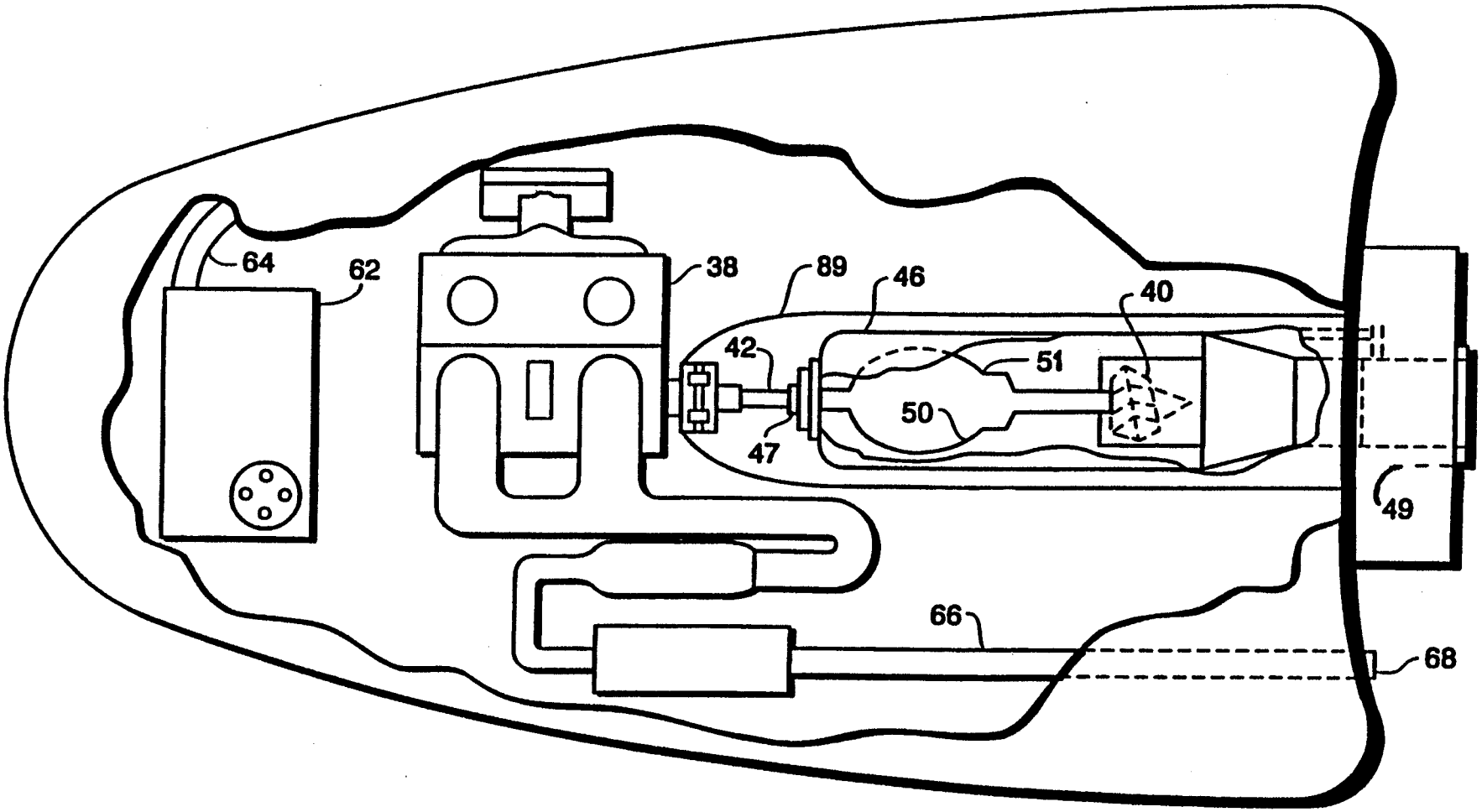
FIG. 6 is an isometric top view of the boat of the present invention showing a portion of the deck cut away in order to illustrate the motor and associated components thereof.
Figure 7:
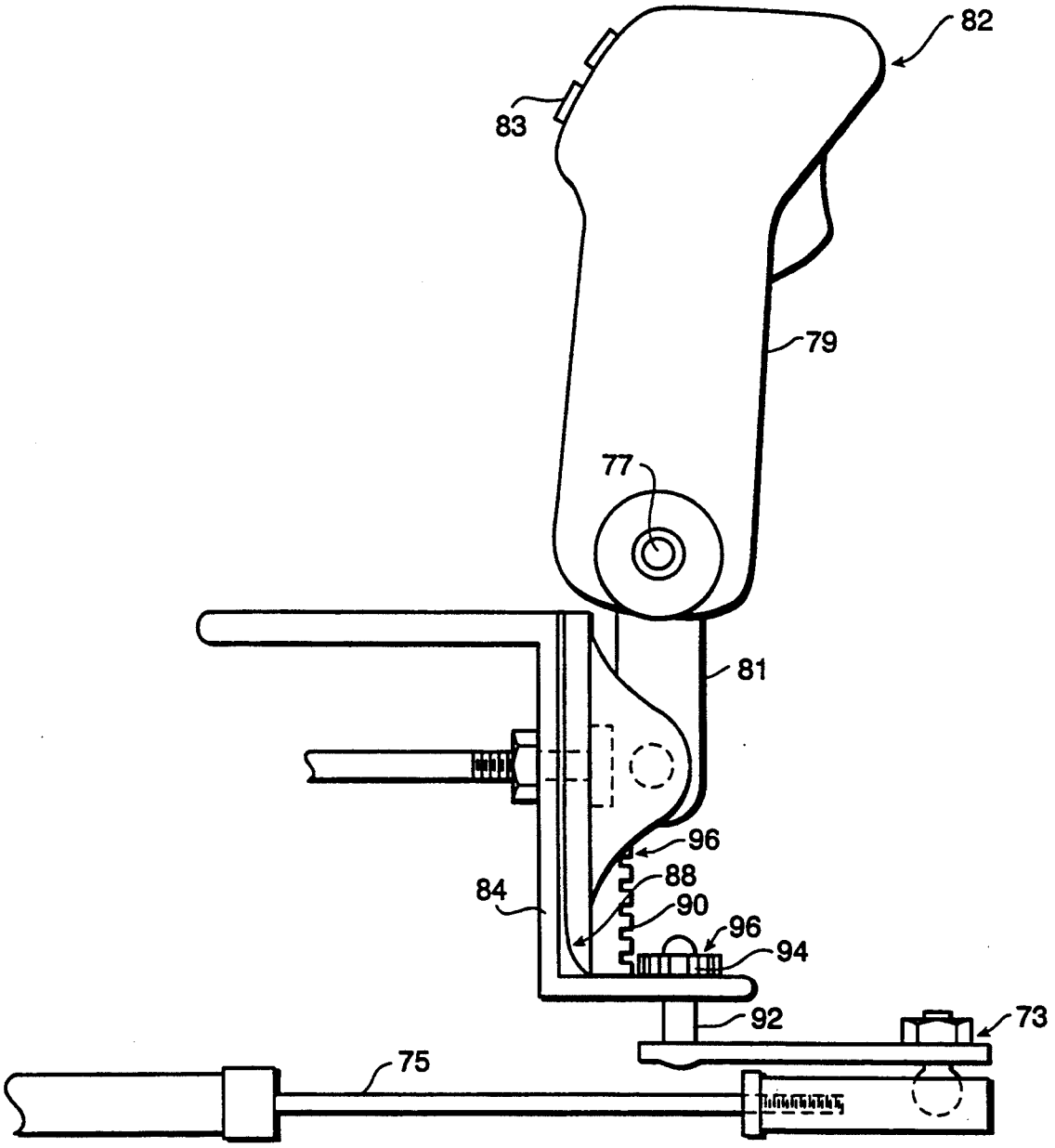
FIG. 7 is an isometric side view of the control stick and rack and pinion structure of the boat of the present invention.

A control 82 is shown in detail in FIGS. 7 and 8. Control 82 is preferably mounted on deck 28. The control 82 is preferably a stick type of control and more preferably a joystick type of control. Joystick 82 is preferably connected to a mount 84 which is securely attached to the deck 32 (or hull 12). Joystick or control stick 82 is preferably attached to mount 84 by means of a two point swivel shaft structure 86. This allows the control stick to move laterally with respect to the deck 32 and hull 12. Control stick 82 preferably is attached to a rack structure 88 which preferably includes a rack gear 90. A pinion structure 92 is preferably also mounted on the deck structure 28. Pinion structure 92 preferably includes a pinion gear 94, which is rotatably mounted on mount 84 and engages teeth 96 of rack structure gear 90 via teeth 98 of pinion gear 94. Pinion structure 92 is preferably operatively connected to a linkage structure 73 which preferably includes a steering rod 75, preferably connected to the nozzle 48 for rotational movement thereof. Thus, preferably lateral movement of the control stick 82 results in rotation of pinion gear 94 and preferably generally horizontal rotational movement of nozzle 48. Control stick 82 preferably includes a handle 79 at an upper portion thereof. Handle is connected to a lower portion 81 of the stick 82 by means of an axle structure 77. The axle structure 77 is mounted transversely, thereby allowing the handle 79 to generally fold forward upon exertion thereon of a generally forwardly directed force of a selected magnitude.

Joystick 82 preferably also includes switches 83 preferably operatively connected to the motor 38. Switches 83 are preferably mounted on an upper portion of the handle 79, as shown. Switches preferably include an on/off ignition switch and a start switch. Handle 79 preferably includes a throttle cable structure 85 and engine wires 87 which extend therefrom to appropriate parts of the motor 38. In the event of an accident or rough waters which result in a user being thrust forward on the boat 10, the axle structure 77 would allow the handle 79 to generally fold forward thereby preventing injury to the user that would otherwise result from forceful contact with the handle. This results in a generally safer boat structure.

A shroud 89 is preferably also provided at the lower hull portion 14. The shroud 89 preferably generally at least partly encloses the lower and lateral portions of the tube 46 and nozzle 48. The shroud 89 preferably is approximately medially positioned and longitudinally oriented on the lower hull portion 14. The shroud 89 preferably extends from an approximately central portion of the lower hull portion 14 to the aft portion 70. The shroud 89 is also generally rectangular in cross-section and generally shaped and dimensioned so that it generally conforms to the general shape and dimensions of the flat bottom portion 21, as shown in FIGS. 2 and 5. The general shape and dimensioning of the shroud 89 allows the V-shaped portion 18, the flat bottom portion 21 and the shroud 89 to generally blend together with the flat surface 31 generally continuing to the rear portion of the hull, thereby improving the aquadynamics of the craft 10. Thus, the V-shaped portion 18 provides improved lateral stability to the craft 10, while the shroud 89 and flat bottom portion 21 provide enhanced high speed capability to the craft 10.

Shroud 89 preferably includes an inlet hole 51 which generally snugly encircles the inlet portion 50 for the tube 46 for a generally water tight fit. Shroud 89 preferably also includes an outlet hole 49 which generally encircles the nozzle 48. Generally, shroud 89 has closed forward portions 91 which generally prevent movement with water through the shroud 89, thereby preventing water turbulence in the area between the shroud and the nozzle 48 thereby allowing a generally freer movement of the nozzle 48 during steering thereof. Shroud 89 is preferably also provided with a rear cover 93 to generally close the area at the rear of the shroud i.e., the area between the nozzle and the rear edges 53 of the shroud. However, the area at the rear of the shroud 89 also may be left open if it is deemed that the water turbulence therein would be acceptably low especially in comparison to designs wherein the shroud 89 has open areas allowing water flow therethrough. Shroud 89 preferably also includes a stepped portion or step 95 allowing a person to step up or down on the step 95 while getting on or off the boat 10. The shroud 89 and the lower hull portion 14 are preferably of unitary construction such that shroud 89 and hull 12 are integral in order to enhance aquadynamics of the craft 10 by presenting less resistance to water movement along the lower surface 16 during increment of the craft 10.

A dash 97 is preferably provided on the deck 28. The dash 97 preferably includes instruments (not shown) mounted thereon .

Accordingly, there has been provided, in accordance with the invention, a jet-powered, single person boat which provides improved maneuverability and stability as well as being safer to operate than comparable prior art boats. It is to be understood that all the terms used herein are descriptive rather than limited. Although the invention has been described in conjunction with the specific embodiment set forth above, many alternative embodiments, modifications, and variations will be apparent to those skilled in the art in light of the disclosure set forth herein. Accordingly, it is intended to include also the alternatives, embodiments, modifications and variations that fall within the spirit and scope of the invention as set forth in the claims hereinbelow.

I claim:

1. A boat, comprising:

a hull including a lower hull portion having a generally V-shaped fore portion in cross-section thereof, said V-shaped fore portion extending generally width of said lower hull portion, said lower hull portion having a flat bottom surface at a mid portion and at an aft portion thereof, said V-shaped fore portion having a pointed portion, entire said pointed portion extending downward to a depth approximately equal to depth of said flat bottom surface, said lower hull portion having an upwardly slanted rear portion, said hull having a transom with generally rounded edge portions thereof, said hull having a cavity;

a motor mounted in the cavity;

a deck mounted on said hull, said deck having a generally flat surface portion dimensioned to allow a person to lie prone thereon while operating the boat;

a shroud mounted on the lower hull portion, said shroud having a generally rectangular shape in cross-section and dimensioned to generally conform to the general shape and dimensions of the flat bottom lower hull portion in order to enable the flat bottom surface of the lower hull portion to extend generally continuously to the rear portion of said hull.

2. The boat of claim 1 wherein said hull includes a set of knife chines mounted at lateral portions of the lower portion, said set of knife chines oriented generally parallel to each other and extending generally downwardly from said hull.

3. The boat of claim 1 further including:

an impeller connected to said motor;

a tube defining a chamber generally enclosing said impeller, said tube mounted on the lower hull portion;

a nozzle mounted on said tube, said nozzle positioned approximately rearward of said impeller to allow water set into motion by the impeller to exit therefrom in order to propel the boat.

4. The boat of claim 3 further including a shroud mounted on the lower hull portion, said shroud generally at least partly enclosing lower and lateral portions of said tube and said nozzle.

5. The boat of claim 4 wherein said shroud has an inlet hole to allow water to enter only the chamber.

6. The boat of claim 4 wherein said shroud and said hull are of unitary construction.

7. The boat of claim 1 further including a gunnel mounted on lateral portions of said deck.

8. The boat of claim 1 further including a control stick mounted on said deck, said control stick operatively connected to said motor and said nozzle, said control stick having a handle for manual operation thereof.

9. A motor powered boat dimensioned for single person use, comprising:

a hull including a lower hull portion having a fore portion having a generally V-shape in cross-section, said lower hull portion having a mid portion and an aft portion having a flat bottom surface, said fore portion having a medially located pointed portion extending longitudinally generally to said mid portion, said pointed portion extending downwardly generally to a depth approximately equal to depth of said flat bottom surface so that the depth of entire said pointed portion is approximately equal to the depth of said flat bottom surface, said hull having a cavity;

a motor mounted in the cavity, said motor having an impeller;

a deck mounted on said hull, said deck having a generally flat surface portion dimensioned to allow a person to lie prone thereon while operating the boat;

a gunnel mounted on said deck;

a tube mounted on the lower hull portion and positioned to generally enclose said impeller;

a nozzle mounted on an end of said tube and positioned generally rearward of said impeller to allow water set in motion by said impeller to exit therefrom in order to propel the boat;

a shroud partly enclosing lateral and lower portions of said nozzle and mounted on the lower hull portion, said shroud laterally spaced from said nozzle to allow rotational movement of said nozzle relative to said hull, said shroud having generally closed front portions to generally prevent water flow through said shroud for generally preventing water turbulence in an area generally between said nozzle and said shroud in order to generally provide free movement of said nozzle relative to the boat to facilitate steering of the boat;

a control stick mounted on said deck, said stick operatively connected to said nozzle.

10. The boat of claim 9 further including knife chines mounted at lateral ends of the lower hull portion, said knife chines oriented generally parallel to each other.

11. The boat of claim 9 wherein said lower hull portion includes an upwardly slanted rear portion, said upwardly slanted rear portion extending entire height of said lower hull portion.

12. The boat of claim 9 further including a transom mounted on the lower hull portion, said transom having generally rounded edged portions to facilitate movement of water thereagainst in order to enhance aquadynamics of the boat.

13. The boat of claim 9 wherein said shroud has a generally rectangular cross-sectional shape and is shaped and dimensioned to generally conform to the flat bottom surface of the lower hull portion so that the flat surface of the lower hull portion extends generally continuously to the rear portion of said hull.

14. The boat of claim 9 wherein said shroud includes an inlet hole to allow water to enter only said tube for expulsion of the water by said impeller through said nozzle for propelling the boat.

15. The boat of claim 9 wherein said hull includes a rear portion which is generally curved laterally and forwardly with approximately medial portions thereof more proximal a central portion of said hull than approximately lateral portions thereof.

16. The boat of claim 9 wherein said control stick includes a hinge for hingedly mounting said stick on said deck to allow said stick to freely fold forward during operation upon impact to generally prevent injury to a user.

17. A boat, comprising:

a hull including a lower hull portion having a generally V-shape in cross-section at a fore portion thereof and a flat bottom surface at a mid portion and at an aft portion thereof, said lower hull portion having an upwardly slanted rear portion, said hull having a transom with generally rounded edge portions thereof, said hull having a rear portion generally laterally curved forwardly so that approximately medial portions thereof are more proximal a central portion of said hull than approximately lateral portions thereof, said hull having a cavity;

a motor mounted in the cavity;

a deck mounted on said hull, said deck having a generally flat surface portion dimensioned to allow a person to lie prone thereon while operating the boat;

a shroud mounted on the lower hull portion, said shroud having a generally rectangular shape in cross-section and dimensioned to generally conform to the general shape and dimensions of the flat bottom lower hull portion in order to enable the flat bottom surface of the lower hull portion to extend generally continuously to the rear portion of said hull.

18. A boat, comprising:

a hull including a lower hull portion having a generally V-shape in cross-section at a fore portion thereof and a flat bottom surface at a mid portion and at an aft portion thereof, said lower hull portion having an upwardly slanted rear portion, said hull having a transom with generally rounded edge portions thereof, said hull having a cavity;

a motor mounted in the cavity, said motor having an impeller;

a tube defining a chamber generally enclosing said impeller, said tube mounted on the lower hull portion;

a nozzle mounted on said tube, said nozzle positioned approximately rearward of said impeller to allow water set into motion by the impeller to exit therefrom in order to propel the boat;

a deck mounted on said hull, said deck having a generally flat surface portion dimensioned to allow a person to lie prone thereon while operating the boat;

a shroud mounted on the lower hull portion, said shroud having a generally rectangular shape in cross-section and dimensioned to generally conform to the general shape and dimensions of the flat bottom lower hull portion in order to enable the flat bottom surface of the lower hull portion to extend generally continuously to the rear portion of said hull, said shroud generally at least partly enclosing lower and lateral portions of said tube and said nozzle, said shroud including generally closed portions in order to prevent flow of water through said shroud to minimize water turbulence within said shroud and adjacent said nozzle for providing generally free movement of said nozzle within said shroud and relative to said hull to facilitate steering of the boat.

19. A boat, comprising:

a hull having a cavity;

a motor mounted in the cavity, said motor having an impeller;

a deck mounted on said hull, said deck having a generally flat surface portion to allow a person to lie prone thereon while operating the boat;

a nozzle rotatably mounted on a lower hull portion of said hull, said nozzle positioned generally rearward of said impeller to allow water set in motion by said impeller to exit therefrom for propelling the boat:;

a control stick mounted on said deck and operatively connected to said nozzle and said motor, said stick hingedly mounted on said deck to allow said stick to fold forward to generally prevent injury to a user, said stick having a handle for manual operation thereof;

a rack structure rigidly connected to said stick, said rack structure rotatably mounted on said deck, said rack structure having rack teeth;

a pinion structure mounted on said deck, said pinion structure having pinion teeth, said pinion structure having a gear rotatably mounted on said deck, said gear having gear teeth for engaging said rack teeth in order to rotate said pinion gear in response to rotational movement of said control stick;

a linkage structure interconnecting said pinion structure and said nozzle to allow rotation of said nozzle in response to rotation of said pinion for steering the boat.

20. A boat, comprising:

a hull having a cavity;

a motor mounted in the cavity, said motor having an impeller;

a deck mounted on said hull, said deck having a generally flat surface portion to allow a person to lie prone thereon while operating the boat;

a nozzle rotatably mounted on a lower hull portion of said hull, said nozzle positioned generally rearward of said impeller to allow water set in motion by said impeller to exit therefrom for propelling the boat;

a control stick mounted on said deck and operatively connected to said nozzle and said motor, said stick hingedly mounted on said deck to allow said stick to fold forward to generally prevent injury to a user, said stick having a handle for manual operation thereof;

a gunnel mounted on said deck, said gunnel containing an air intake, a fuel filler, and an exhaust pipe, said exhaust pipe having a generally looped configuration, said exhaust pipe positioned within said gunnel.

21. A motor powered boat dimensioned for single person use, comprising:

a hull including a lower hull portion having a fore portion having a generally V-shape in cross-section, said lower hull portion having a mid portion and an aft portion having a flat bottom surface, said hull having a cavity;

a motor mounted in the cavity, said motor having an impeller;

a deck mounted on said hull, said deck having a generally flat surface portion dimensioned to allow a person to lie prone thereon while operating the boat;

a gunnel mounted on said deck;

a tube mounted on the lower hull portion and positioned to generally enclose said impeller;

a nozzle mounted on an end of said tube and positioned generally rearward of said impeller to allow water set in motion by said impeller to exit therefrom in order to propel the boat;

a shroud partly enclosing lateral and lower portions of said nozzle and mounted on the lower hull portion, said shroud laterally spaced from said nozzle to allow rotational movement of said nozzle relative to said hull, said shroud having generally closed front portions to generally prevent water flow through said shroud for generally preventing water turbulence in an area generally between said nozzle and said shroud in order to generally provide free movement of said nozzle relative to the boat to facilitate steering of the boat;

a control stick mounted on said deck, said stick operatively connected to said nozzle;

a rack structure connected to a lower portion of said control stick, said rack structure having a gear, said gear rotatably mounted on said deck;

a pinion structure mounted on said deck and rotatable relative thereto, said pinion having a pinion gear rotatably mounted on said deck and engaging said rack gear for relative rotational movement therebetween;

a linkage structure interconnecting said pinion structure and said nozzle to allow rotation of said stick to rotate said nozzle so that movement of said stick enables steering of the boat.

22. A boat, comprising:

a hull including a lower hull portion having a generally V-shape in cross section at a fore portion thereof and a flat bottom surface at a mid portion and at an aft portion thereof, said hull having a transom with generally rounded edge portions thereof, said hull having a pair of chines at lateral end portions of said lower hull portion, said pair of chines oriented generally parallel to each other and extending generally downwardly from said lower hull portion, said hull having a cavity;

a motor mounted in the cavity;

a deck mounted on said hull, said deck having a generally flat surface portion dimensioned to allow a person to lie prone thereon while operating the boat;

a shroud mounted on the lower hull portion, said shroud having a generally rectangular shape in cross-section and dimensioned to generally conform to the general shape and dimensions of the flat bottom lower hull portion in order to enable the flat bottom surface of the lower hull portion to extend generally continuously to the rear portion of said hull.

23. A boat, comprising:

a hull having a cavity;

a motor mounted in the cavity, said motor having an impeller, said motor tilted laterally to minimize vertical dimensions of said hull;

a deck mounted on said hull, said deck having a generally flat surface portion to allow a person to lie prone thereon while operating the boat;

a nozzle rotatably mounted on a lower hull portion of said hull, said nozzle positioned generally rearward of said impeller to allow water set in motion by said impeller to exit therefrom for propelling the boat;

a control stick mounted on said deck, said stick having a handle for manual operation thereof;

a linkage rod connected to said control stick, said linkage rod operatively connected directly to said nozzle for steering the boat.

* * * * *